US009747798B2

(12) United States Patent
Moise

(10) Patent No.: US 9,747,798 B2
(45) Date of Patent: Aug. 29, 2017

(54) METHOD FOR LOCATING PARKING SPACES

(71) Applicant: Johnny Moise, Brooklyn, NY (US)

(72) Inventor: Johnny Moise, Brooklyn, NY (US)

( * ) Notice: Subject to any disclaimer, the term of this patent is extended or adjusted under 35 U.S.C. 154(b) by 0 days.

(21) Appl. No.: 14/884,386

(22) Filed: Oct. 15, 2015

(65) Prior Publication Data

US 2016/0111002 A1 Apr. 21, 2016

Related U.S. Application Data

(60) Provisional application No. 62/064,025, filed on Oct. 15, 2014.

(51) Int. Cl.
*G08G 1/14* (2006.01)

(52) U.S. Cl.
CPC ..... *G08G 1/147* (2013.01); *G08G 1/144* (2013.01)

(58) Field of Classification Search
CPC ..... G08G 1/14; G08G 1/142; G08G 1/144; G08G 1/147; G06Q 10/02; G06Q 50/30
USPC ..... 340/932.2; 701/423, 454; 705/26.8, 28
See application file for complete search history.

(56) References Cited

U.S. PATENT DOCUMENTS

| | | | | |
|---|---|---|---|---|
| 7,834,778 | B2 | 11/2010 | Browne et al. | |
| 8,306,734 | B2 | 11/2012 | Mathews | |
| 2003/0112154 | A1 | 6/2003 | Yoakum et al. | |
| 2006/0267799 | A1 | 11/2006 | Mendelson | |
| 2012/0265434 | A1 | 10/2012 | Woodard et al. | |
| 2014/0085109 | A1* | 3/2014 | Stefik | G06Q 10/02 340/932.2 |
| 2014/0176349 | A1* | 6/2014 | Smullin | G08G 1/142 340/932.2 |
| 2014/0292541 | A1* | 10/2014 | Korman | G08G 1/144 340/932.2 |
| 2015/0346727 | A1* | 12/2015 | Ramanujam | B62D 15/0285 701/23 |

* cited by examiner

*Primary Examiner* — Hung T Nguyen
(74) *Attorney, Agent, or Firm* — Global Intellectual Property Agency, LLC

(57) ABSTRACT

A computer-implemented method for locating open parking spaces. The method includes the steps of receiving, at a server database, location information from a user via a wireless transmission over a network, transmitting parking rules for an area within a particular radius of the location from the server to the user, transmitting the location of open parking spaces for an area within a particular radius of the location, and displaying a map showing the location of the open parking space. Once parked, the user may upload to the database the changed condition of the occupied parking space. The server also communicates to the user a notification when the parking time limit of the occupied space is a particular amount of time from being reached so that a user knows to vacate the space.

11 Claims, 4 Drawing Sheets

METHOD FOR LOCATING PARKING SPACES

CROSS REFERENCE TO RELATED APPLICATIONS

This application claims the benefit of U.S. Provisional Application No. 62/064,025 filed on Oct. 15, 2014. The above identified patent application is herein incorporated by reference in its entirety to provide continuity of disclosure.

FIELD OF THE INVENTION

The present invention relates to methods for determining parking space locations. More particularly, the present invention relates to methods for identifying open parking spaces and directing users thereto.

BACKGROUND OF THE INVENTION

As the number of vehicles on the road increases each year, parking spaces become more and more scarce. It is often difficult to locate a parking spot, particularly in cities, where vacant parking spaces are few and far between. Parking lots and garages often charge high prices for the ability to use a dedicated parking space. While street parking spaces may provide a less expensive option for parking, available street parking is becoming increasingly difficult to locate. Drivers must spend valuable time searching for an available space, often only to end up paying high prices to park in a garage or lot. Therefore, a method for identifying open parking spaces that provides for communication of the parking space availability to users is desired.

In addition to limited parking availability, complex and varying parking rules also contribute to inefficiencies of parking. Parking regulations and signs are often difficult to decipher. This is particularly a problem for a motorist who must reach a destination and quickly leave the vehicle. This may lead to expensive unwanted parking tickets. It is therefore desired to provide a method that includes the step of transmitting parking rules and regulations to a user.

Effective communication of parking space conditions is one way to increase parking efficiency and reduce the time it takes to find an open spot. The ubiquitous nature of wireless networks supports a system for users to self-report the condition of parking spaces for the benefit of both themselves and others using said system. It is therefore desirable to provide a method that utilizes an existing network for transmitting parking space information to a user for locating vacant parking spaces that allows drivers to self-report the occupancy of the parking space.

SUMMARY OF THE INVENTION

In view of the foregoing disadvantages inherent in the known types of parking systems now present in the prior art, the present invention provides a method for locating open parking spaces wherein the same can be utilized for providing convenience for the user when searching for parking.

It is therefore one object of the present invention to provide a method for providing parking space location and availability having all of the advantages of the prior art and none of the disadvantages.

Another object of the present invention is to provide the ability for users to wirelessly transmit parking space occupancy information to a database via a communications network.

More objectives of the present invention will become apparent in the following detailed description of the figures.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
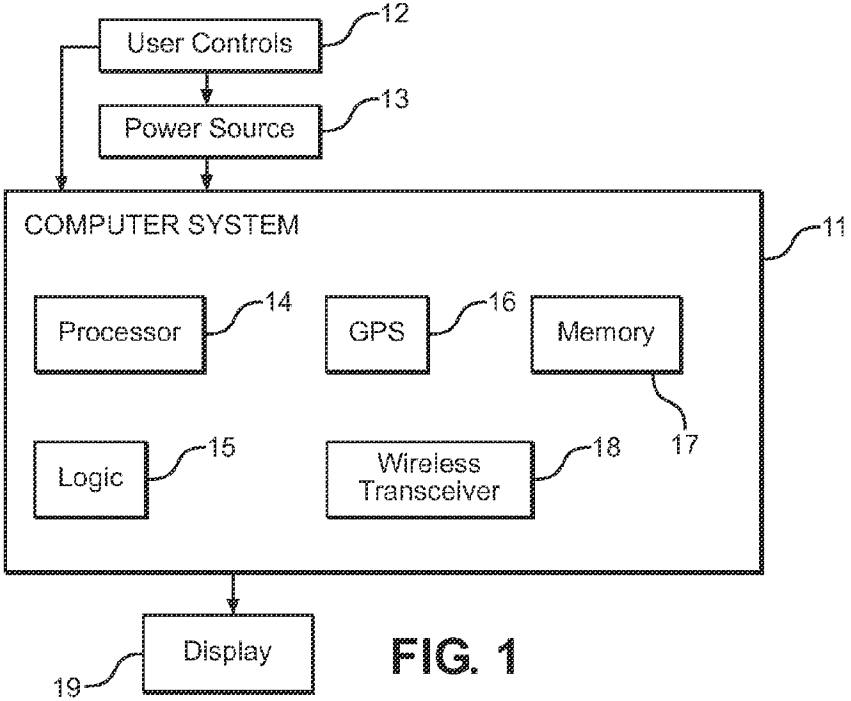
FIG. 1 shows a diagram of a computer system configured to implement the present method.

Reference is made herein to the attached drawings. Like reference numerals are used throughout the drawings to depict like or similar elements of the present method. For the purposes of presenting a brief and clear description of the present invention, the preferred embodiment will be discussed as used in conjunction with a mobile device. The figures are intended for representative purposes only and should not be considered to be limiting in any respect.

As used herein, "logic" refers to (i) logic implemented as computer instructions and/or data within one or more computer processes and/or (ii) logic implemented in electronic circuitry.

As used herein, "computer-readable medium" excludes any transitory signals, but includes any non-transitory data storage circuitry, e.g., buffers, cache, and queues, within transceivers of transitory signals.

According to some embodiments, the operations, techniques, and/or components described herein can be implemented by an electronic device, which can include one or more special-purpose computing devices. The special-purpose computing devices can be hard-wired to perform the operations, techniques, and/or components described herein, or can include digital electronic devices such as one or more application-specific integrated circuits (ASICs) or field programmable gate arrays (FPGAs) that are persistently programmed to perform the operations, techniques and/or components described herein, or can include one or more general purpose hardware processors programmed to perform such features of the present disclosure pursuant to program instructions in firmware, memory, other storage, or a combination. Such special-purpose computing devices can also combine custom hard-wired logic, ASICs, or FPGAs with custom programming to accomplish the technique and other features of the present disclosure. The special-purpose computing devices can be desktop computer systems, portable computer systems, handheld devices, networking devices, or any other device that incorporates hard-wired and/or program logic to implement the techniques and other features of the present invention.

The present invention provides a method of remotely conveying parking space location and occupancy details to a user. The present method may be implemented via software stored on a device capable of wirelessly transmitting and receiving information. The method allows users to send their current location to a database having parking location information stored thereon. The database then transmits local parking regulations to the user, as well as the location of open parking locations. The method also provides for directing the user to the open space. Once occupying the space, the user may send the changed condition of the space, i.e. the fact that the space is now occupied, to the database. The database can then notify the user when the legal time limit for parking in that particular space is reached, allowing users to move their vehicle before receiving a ticket for a parking violation.

Referring now to FIG. 1, there is shown a diagram of a computer system configured to implement the present method. Included are user controls 12 operatively connected to a power source 13 and a computer system 11. The computer system 11 comprises a computer readable medium, which is shown here as a memory 17. The computer system 11 further comprises a processor 14, and a logic 15 stored on the memory 17. When the logic 15 is executed, the processor 14 causes the computer system 11 to perform a method according to the present invention.

The computer system 11 further comprises a wireless transceiver 18 that is configured to send and receive information over a network, e.g. a telecommunications network, and a GPS system 16 that is configured to monitor the physical location of the computer system 11 via one or more GPS satellites in operative communication therewith. The computer system 11 also includes a display 19. The display 19 is capable of displaying parking regulation information and geographic parking location information. Each of the processor 14, memory 17, wireless transceiver 18, and display 19 are in operative communication with one another and with the power source 13. The computer system 11 may be embodied in a mobile device or may be integrated into a vehicle.

Figure 2:
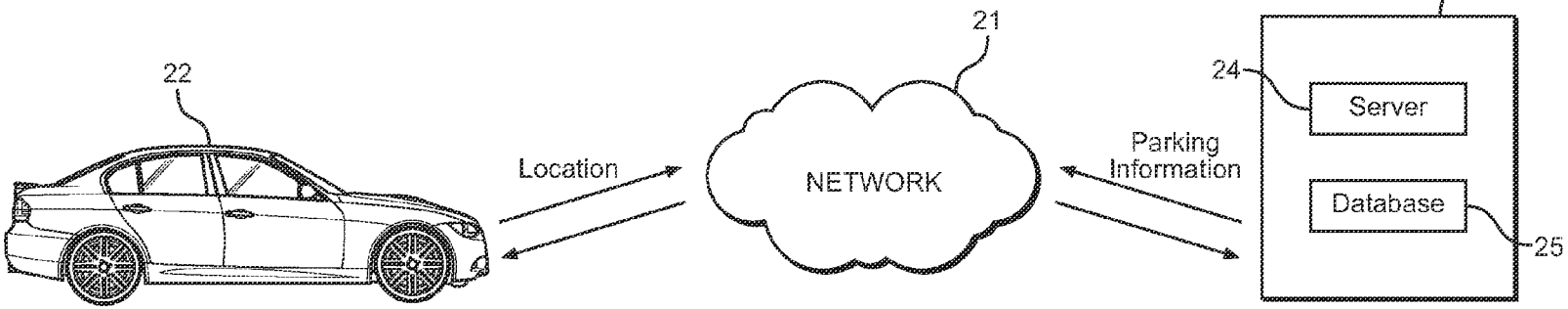
FIG. 2 shows a diagram of wirelessly communicated information according to the present method.

Referring now to FIG. 2, there is shown a diagram of wirelessly communicated information according to the present method. A user 22 of the computer system 11 transmits their current location information, which is determined by the GPS system 16, over a wireless network 21 via the wireless transceiver 18. The wireless network 21 may be a cellular network, wireless internet network, or similar.

Figure 3:
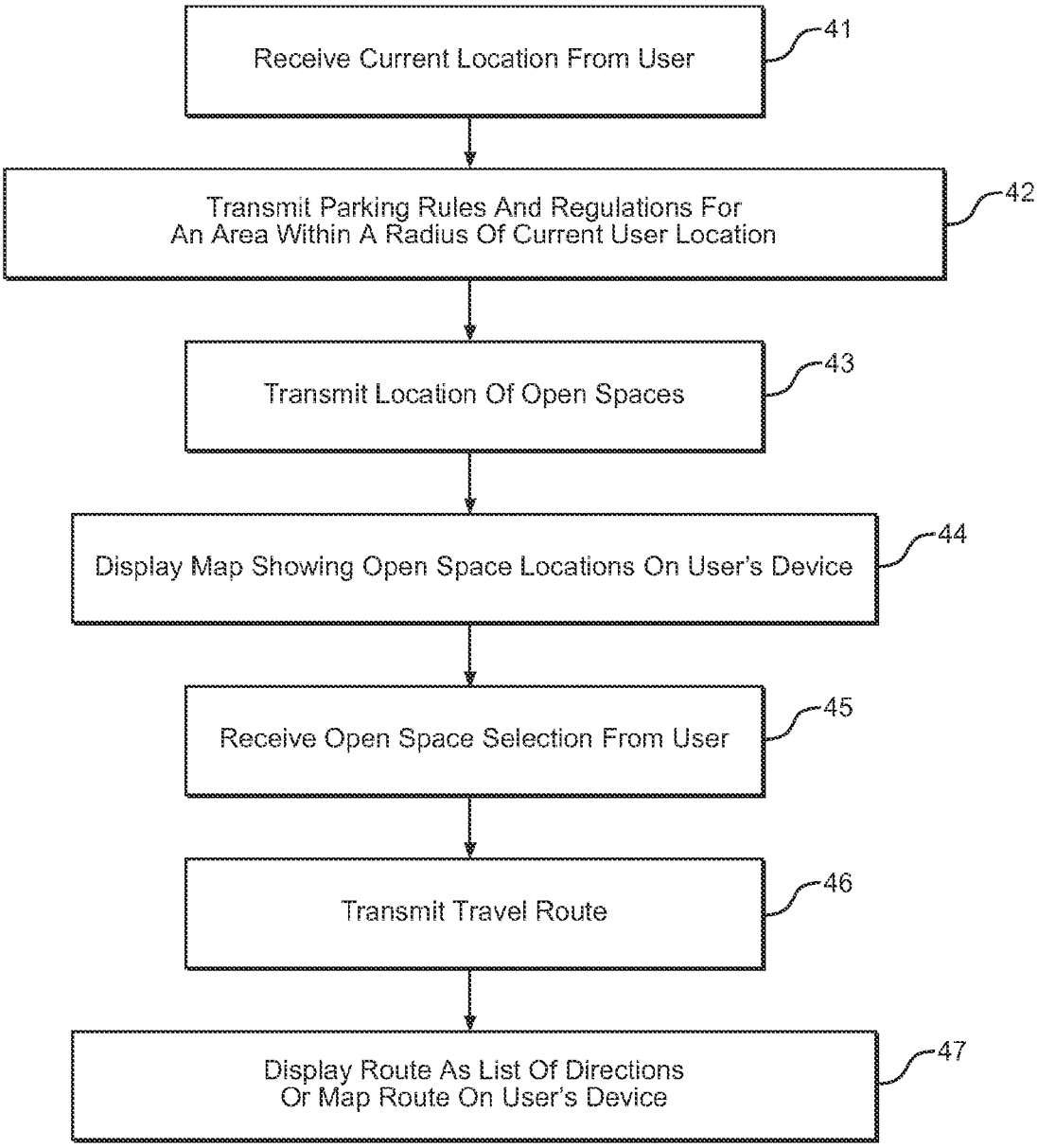
FIG. 3 shows a flowchart of the steps according to an embodiment of the present method.

Referring now to FIG. 3, a flowchart of the steps according to an embodiment of the present method is shown. In a first step 41, the logic 15 causes location information of the user 22 to be sent to and received by a remote computer system 23 comprising at least a database 25 and a server 24. The information is received via the server 24 and stored on the database 25. The database 25 further comprises a list of parking rules and regulations stored thereon. After the server 24 receives the user's location information, the logic 15 is configured to receive from the computer system 23 the parking rules and regulations that apply to a particular geographic radius emanating from the user's location. The server 24 then transmits to the user 22 the parking rules and regulations for the area within the designated geographic radius of the user's location 42 in the next step 42. The logic 15 additionally causes the parking rules and regulations may additionally be displayed on the display 19 so the user may be aware of the parking rules when trying to locate a parking space.

The database 25 also maintains a list of parking spaces and a value for the parking spaces designating it as occupied or unoccupied. The condition of the space is dependent on the input of users other than the user 22. In one embodiment, in addition to the local parking rules, the logic 15 is configured to receive from the server 24 a transmission to the user 22 detailing the location of open parking spaces within a particular radius of their transmitted location in another step 44. The open or filled condition of parking spaces stored in the database 25 may be determined by other users of the present method, who may transmit the condition of a parking space to the server 24 over the network 21. In another embodiment, another additional step 45 consists of the logic 15 causing the computer system 11 to display a map showing the location of open parking spaces on the display 19.

In a further step 46, the logic 15 is configured to transmit to the server 24 a selection of a particular open space from the user 22. In this instance, the logic 15 is configured to receive from the server 22 a communication to the user 22 of an optimal route of travel to the selected parking space 48. In another additional step, the logic 15 is configured to receive from the computer system 23 the optimal route of travel to the selected space, which may then be transmitted to the user in an additional step 48 and displayed on the display screen 19 as the following step 49. The logic may also be configured to display the route of travel on a map or as driving directions in a list format.

Figure 4:
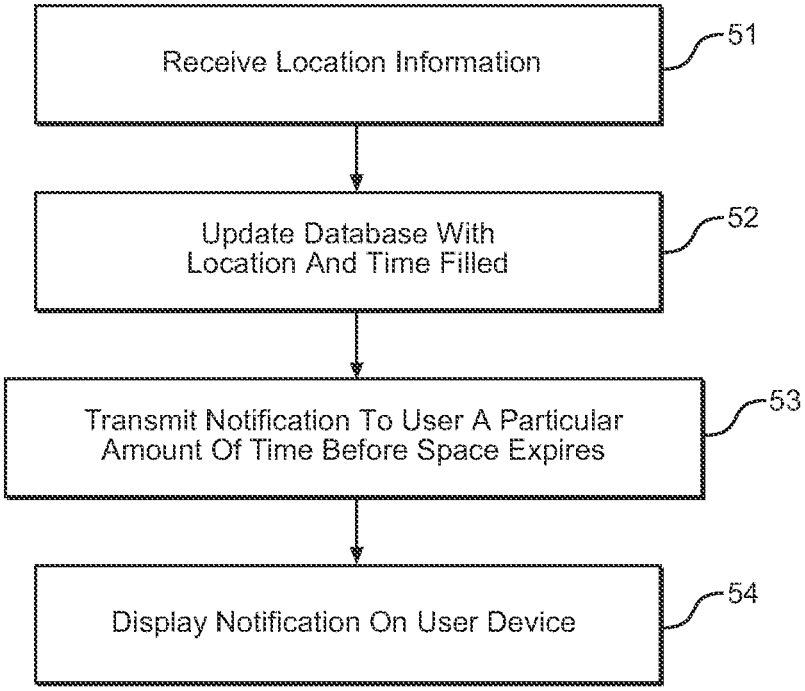
FIG. 4 shows a flowchart of the steps according to an alternative embodiment of the present method.

Referring now to FIG. 4, a flowchart of the steps according to an alternative embodiment of the present method is shown. In a first additional step 51, the logic 15 is configured to send to the server 24 location information from the user 22 detailing the physical location of the user's 22 chosen parking space 51 after the user has parked their vehicle therein. The database 25 is then updated to change the condition of the particular parking space to reflect its current occupation. If a user 22 fills a space and updates the database 25, other users in the surrounding area searching for parking will be notified that the parking space has been filled and directed to alternative spaces, if requested.

After a period of time has passed since the user 22 has updated the database 25 with their parking space location, the server 24 sends a notification to the user 22 alerting them to the parking rules regarding allotted parking time. The user can configure the amount of time that remains before their parking space privileges expires before causing the server 24 to send the notification, so that the user 22 may return to the vehicle and move it before receiving a ticket. In the next step, the notification may be displayed on the user's 22 device 54.

Figure 5:
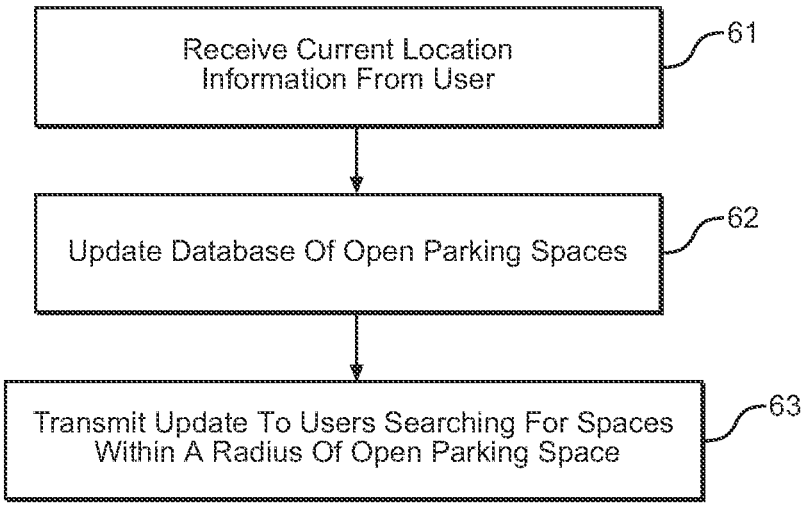
FIG. 5 shows a flowchart of the steps according to an alternative embodiment of the present method.

Referring now to FIG. 5, there is shown a flowchart of the steps according to an alternative embodiment of the present method. A user 22 may report the condition of a parking space in order to maintain accurate information regarding parking availability is stored on the database 25. The database 25 includes a list of metered and unmetered parking locations stored thereon. In some cases, a selected open space may be occupied by a non-user or a user that declines to report the space occupancy information by the time the user 22 arrives at the parking space. In this instance, the user may choose to communicate to the server 24 the changed condition of the parking space. The database 25 then updates the condition of the particular parking space and sends the updated condition to the user 22, as well as other users 63. In this way, the database 25 is constantly updated with parking conditions and may provide alternative open spaces should the initially chosen space be filled before the user 22 arrives.

Figure 6:
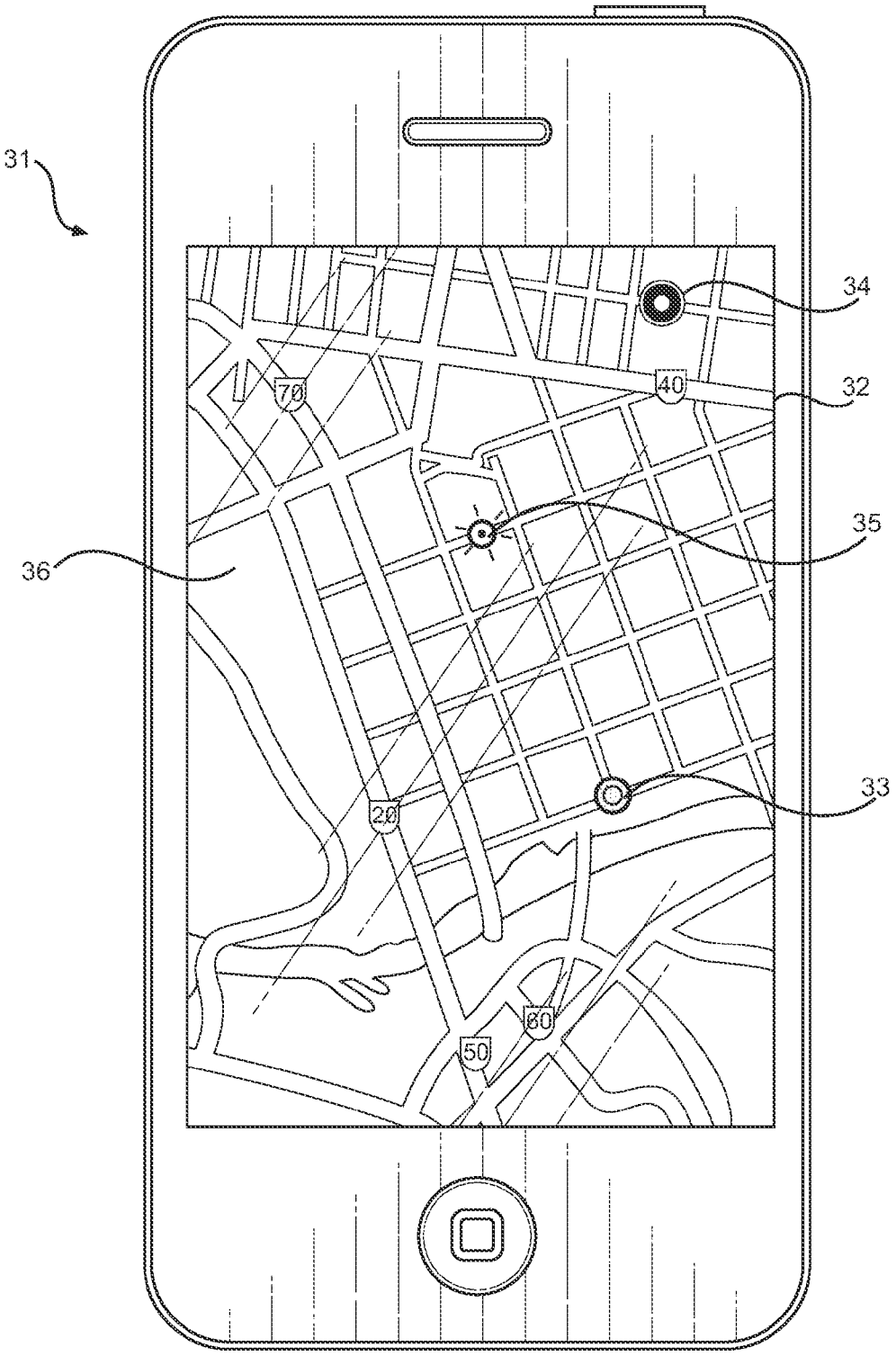
FIG. 6 shows a device displaying a map with parking information communicated according to the steps of an illustrative embodiment of the present method.

Referring now to FIG. 6, a device displaying open parking spaces is shown. The device 31 comprises a display 32. The display 32 displays a map 36 showing the location of an open parking space 35 and the location of the user vehicle 33. The map additionally shows an occupied space 34 that was open when the user requested the parking information but has since been changed to the condition of occupied by another user. In this way, users may be redirected to an open parking space 35 before reaching the occupied space 34. The driving directions provided to the user may be in audio or visual form.

It is therefore submitted that the instant invention has been shown and described in what is considered to be the most practical and preferred embodiments. It is recognized, however, that departures may be made within the scope of the invention and that obvious modifications will occur to a person skilled in the art.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A computer system for locating parking spaces comprising:

a processor;

a GPS system;

a non-transitory computer readable medium operatively connected to the processor;

a logic stored in the non-transitory computer readable medium that, when executed by the processor, causes the computer system to perform a method, the method comprising steps of:

transmitting a current location of the computer system determined by the GPS system to a remote computer system;

receiving a list of parking regulations corresponding to the computer system location transmitted from the remote computer system;

receiving a list of an available parking space transmitted from the remote computer system, wherein each parking space in the list is assigned either a value representing non-vacancy or a value representing vacancy corresponds to the current location.

2. The computer system of claim 1, wherein the performed method further comprises:

transmitting a space selection to the remote computer system;

receiving a travel route to the space selection from the remote computer system.

3. The computer system of claim 2, wherein the performed method further comprises the step of:

if a first user selects an unoccupied space and the unoccupied space is thereafter occupied, then transmitting an updated condition of the unoccupied space to the first user.

4. The computer system of claim 2, wherein the performed method further comprises the steps of:

sending the occupied status of a parking space to the remote computer system;

receiving from the remote computer system an amount of time a vehicle may legally remain parked in the parking space; and receiving a notification from the remote computer system before the amount of time the vehicle may legally remain parked in the parking space is reached.

5. The computer system of claim 1, wherein the computer system is integrated with a vehicle.

6. The computer system of claim 1, wherein the computer system is a mobile electronic device.

7. A computer-implemented method of locating parking spaces comprising steps of:

sending a current location of a first computer system comprising a GPS system to a remote computer system;

receiving the current location of the first computer system at the remote computer system, the remote computer system comprising a server and a database comprising a list of parking regulations stored thereon, and a list of parking spaces, wherein each space in the list is assigned either a value representing non-vacancy or a value representing vacancy;

retrieving currently open parking spaces from the database; and sending information regarding currently open parking spaces from the remote computer system to the first computer system including the list of parking regulations stored thereon, and the list of parking spaces, wherein each parking space in the list is assigned either a value representing non-vacancy or a value representing vacancy.

8. The method of claim 7, wherein the first computer system is a smartphone.

9. The method of claim 7, wherein the first computer system is integrated with a vehicle.

10. The method of claim 7, further comprising the steps of:

sending a particular space selection from the first computer system to a second computer system;

receiving the particular space selection at the second computer system;

determining a route of travel to a selected parking space; and sending the route of travel to the first computer system from the second computer system.

11. The method of claim 7, further comprising the steps of:

sending an occupation status of a parking space from the first computer system to the remote computer system;

determining an amount of time a vehicle may legally remain parked in the parking space based on the parking rules stored on the database; and sending a notification from the remote computer system to the first computer system before the amount of time the vehicle may legally remain parked in the parking space is reached.

* * * * *